United States Patent [19]

Stano et al.

[11] Patent Number: 4,797,864

[45] Date of Patent: Jan. 10, 1989

[54] RACE STOPWATCH WITH PLURAL DISPLAYS AND OPERATING MODES

[75] Inventors: Robert R. Stano, Belleville; Richard H. Harrington, Ann Arbor, both of Mich.

[73] Assignee: Robert R. Stano, Belleville, Mich.

[21] Appl. No.: 106,473

[22] Filed: Oct. 9, 1987

[51] Int. Cl.[4] ..... G04F 8/00

[52] U.S. Cl. ..... 368/111; 368/113; 368/107

[58] Field of Search ..... 368/113, 111–112, 368/107–110

[56] References Cited

U.S. PATENT DOCUMENTS

| | | | |
|---|---|---|---|
| 2,832,044 | 4/1958 | Buss | 324/68 |
| 4,340,808 | 7/1982 | Donohoo | 235/92 AC |
| 4,376,995 | 5/1980 | Shimizu | 368/107 |
| 4,505,595 | 3/1988 | Rose et al. | 368/113 |
| 4,657,405 | 4/1987 | Nakazawa | 368/113 |

OTHER PUBLICATIONS

HMCS40 Series, 4 Bit Single-Chip Microcomputer, 7/84, pp. 1–46.

"Winning Gifts from Good Time", advertisement (undated).

*Primary Examiner*—Bernard Roskoski

*Attorney, Agent, or Firm*—Cullen, Sloman Cantor, Grauer, Scott & Rutherford

[57] ABSTRACT

A microprocessor-based electronic timekeeping apparatus or stopwatch for measuring multiple intervals of time, such as the elapsed times of a race horse covering successive distances of a race course, is disclosed. This hand-holdable, self-contained stopwatch has four multiple-digit display fields for simultaneously displaying up to four measured intervals of time preferably in minutes, seconds and fractions of a second. In a first mode of operation, the stopwatch is used to measure and display four overlapping intervals of time having a common starting time and different stopping times. In a second mode of operation, the stopwatch is used to measure multiple intervals of time which have an operator-determined untimed period between successive intervals. The stopwatch includes additional display fields for indicating the mode of operation and the specific intervals of time being displayed. It also includes internal memory so previously measured and displayed intervals of elapsed time can be stored and displayed later. Preferred methods of operating the stopwatch are also disclosed.

17 Claims, 1 Drawing Sheet

RACE STOPWATCH WITH PLURAL DISPLAYS AND OPERATING MODES

BACKGROUND OF THE INVENTION

This invention relates generally to portable, self-contained electronic timekeeping apparatus and in particular to hand-held electronic stopwatches for measuring intervals of elapsed time at horse races and the like.

Many sporting events involve races where the time required for a participant to cover a specified distance or successive distances is measured, recorded and displayed. Horse racing is a familiar example. Often, at race tracks, the elapsed time required for a given horse to reach the one-quarter mile mark, the one-half mile mark, the three-quarters mile mark and the one-mile mark are measured using large, professional timekeeping systems with distributed input stations where an automatic photocell sensor or a human being indicates when a given horse has crossed a particular mark corresponding to a given distance. These times are then recorded and later published in racing forms, where they are studied by the betting public and horse trainers. It would be desirable to have a relatively inexpensive, hand-held stopwatch which members of the betting public and horse trainers could use themselves to successively measure the elapsed time for these four quarter mile intervals, as the race was in progress. Furthermore, at smaller horse farms where expensive electronic equipment for timing a horse as it covers a race course is not available, it would be extremely useful to have such a stopwatch device to assist trainers and spectators to measure the horse's performance and to use for training purposes. In many other sporting events, such as swimming, relay races at track and field meets, auto races and the like, it would similarly be useful to be able to measure and simultaneously display the elapsed times of a particular swimmer, runner or car over several segments, parts or laps of a race course.

Also, in training racing horses or members of a track team, a training session often involves having the racer cover a specified distance (such as one-quarter mile), then rest for a period of time, then run the specified distance again and record the elapsed time, and so on and repeat this process for a total of eight or nine timed intervals. In order to record the several elapsed times for these successive intervals using a conventional stopwatch, it is necessary for the trainer to manually write down the times in a notebook or the like. Recently, a hand-held electronic stopwatch with a single multiple-digit display for measuring two successive back-to-back time periods has become available. This stopwatch requires the user to push a few buttons to recall the first elapsed time which was stored, which is inconvenient and cumbersome. It would be much more useful and convenient to have a stopwatch which could successively measure and record several of the elapsed times required to cover the successive distances without having to push several buttons to recall each of them. It would also be very useful to provide a stopwatch which would simultaneously display several such elapsed times for comparison purposes.

It would also be most useful for trainers and race spectators to have a stopwatch which could provide both of the modes of operation described above and do so interchangeably, simply by pushing one button once or at most a few times. Furthermore, it would be helpful for the stopwatch to indicate in a simple manner the mode it is in and the step in a sequence of steps for measuring multiple intervals of time it is at.

It is the primary object of the present invention to provide a hand-held, self-contained portable stopwatch which can fulfill the foregoing needs. Another object is to provide a hand-held stopwatch which has a plurality of multiple-digit displays and different modes of operation for measuring multiple intervals of time representing the elapsed times a racer has taken to cover successive predetermined distances. It is another object of the present invention to provide a stopwatch of the foregoing type which has a minimum number of operator controls, and which has additional displays that make the stopwatch easy to understand and operate correctly and efficiently.

SUMMARY OF THE INVENTION

In light of the foregoing needs and objects, there is provided according to one aspect of the present invention a hand-holdable, self-contained portable stopwatch having a plurality of different modes of operation for measuring and displaying a plurality of intervals of time representing the elapsed times a racer has taken to cover successive predetermined distances. The number of intervals of time which are displayed may be as small as two. The number of intervals of time which may be measured, either simultaneously or sequentially, may be as small as two, and may be as many as sixteen, or more if desired. The stopwatch is comprised of: time-base means, such as a conventional crystal oscillator circuit, for providing an internal source of timing signals for the stopwatch; first operator-actuatable switch means, such as a momentary contact pushbutton, for generating first input commands designating start and stop points of the plurality of intervals of time to be measured; and second operator-actuatable input switch means, such as another momentary contact pushbutton, for generating second input commands for switching the stopwatch between at least first and second distinct timing modes of operation. The stopwatch is further comprised of: timing means connected to the time-base means for successively measuring the duration of each of the plurality of intervals of time designated by the input commands received from the first input means; first display means, such as two or more multiple-digit LCD read-outs, for simultaneously displaying at least a plurality of multiple-digit values respectively representing the measured duration of at least two, and preferably four, intervals of time; second display means, such as one or more alphabetic LCD read-outs distinct from the first display means, for indicating when the stopwatch is in its first timing mode and when the stopwatch is in its second timing mode; and a third display means distinct from the first display means for displaying at least one symbol or character, such as a letter or number, indicating which of the plurality of intervals of time the stopwatch is currently set up to time.

The timing means of the stopwatch preferably includes microprocessor means for controlling the sequence of automatic operations of the stopwatch in response to the input commands received from the first and second input means, including automatically operating the three display means and providing the first and second timing modes. The operation of the first timing mode includes measuring at least a plurality of overlapping intervals of time having a common start point and different stop points. The operation of the second timing mode includes measuring at least a plurality of successive non-contiguous intervals of time such that the stop point of any one such interval is separated by an operator-determined length of time from the start point of the next interval of time, if any, to be measured.

According to a second, broader aspect of the present invention, there is provided a hand-holdable, self-contained portable timekeeping apparatus for measuring and displaying a plurality of intervals of elapsed time comprising: time-base means for providing an internal source of timing signals for the apparatus; operator-actuatable input means for generating input commands designating start and stop points of the plurality of intervals of elapsed time to be measured and displayed and for switching into and out of a first mode of operation of the apparatus; timing means connecting to the time-base means for successively measuring the duration of each of the intervals of elapsed time designated by the input commands received from the input means; and display means for simultaneously displaying a plurality of multiple-digit values representing at least two of the plurality of intervals of elapsed time measured and displayed by the apparatus. The timekeeping apparatus preferably includes microprocessor means for controlling the automatic operation of the apparatus in response to input commands received from the input means. The microprocessor means may be programmed to provide a first mode of operation wherein the timing control means measures at least a plurality of the overlapping intervals of time having a common start point and different successive stop points. Alternatively, the microprocessor means may be programmed to provide a first mode of operation wherein the timing means measures at least a first plurality of successive non-contiguous intervals of elapsed time such that the stop point of any one such interval is separated by an operator-determined length of time from the start point of the next such interval of time, if any, to be measured. Clearly, the microprocessor means, if it has sufficient memory space, may be programmed to provide both such modes of operation.

According to a third aspect of the present invention, there is provided a method of operating a hand-holdable, self-contained portable timekeeping apparatus for measuring and displaying a plurality of intervals of time, comprising the steps of: (a) providing an internal source of timing signals for the apparatus; (b) generating input commands in response to operator actuations of input switch means, which commands designate start and stop points of a plurality of intervals of time to be measured and operator selections as to the mode of operation the apparatus is to be in; (c) successively measuring the duration of each of the intervals of elapsed time designated by input commands received from the input switch means; and (d) simultaneously displaying a plurality of values representing at least two of the plurality of intervals of elapsed time measured during step (c).

These and other aspects, objects and advantages of the present invention will be more fully understood by reference to the following detailed description taken in conjunction with the various figures and appended claims.

BRIEF DESCRIPTION OF THE DRAWINGS

The drawings form an integral part of the description of the preferred embodiments and are to be read in conjunction therewith. Identical reference numerals designate like components in the different figures, where.

DETAILED DESCRIPTION OF THE PREFERRED EMBODIMENT

Figure 1:
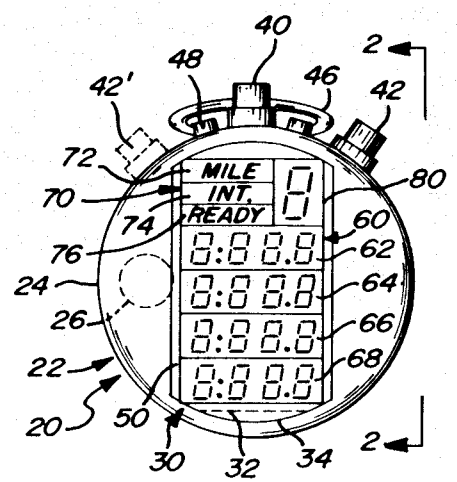
FIG. 1 is a front elevational view of the preferred embodiment of the stopwatch of the present invention, showing the relative location of the two pushbuttons and the several multiple-digit and multiple-character display fields of the electronic display.
Figure 2:
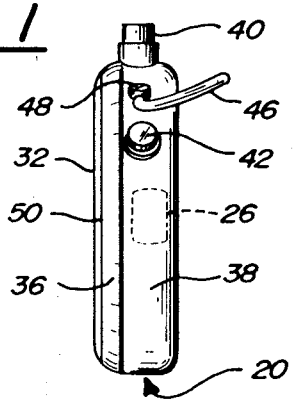
FIG. 2 is a side-elevational view of the FIG. 1 stopwatch taken along line 2—2 of FIG. 1.

Referring to FIGS. 1 and 2, a microprocessor-based electronic timekeeping apparatus or stopwatch 20 for measuring multiple intervals of time, such as the elapsed times of a racer covering successive distances of a racecourse, is shown. The stopwatch 20 is preferably portable and self-contained in a small, protective, impact-resistant housing 22 which may be made of any suitable metal, plastic or other material and which has a generally circular outer rim 24 less than three inches in diameter and preferably two or more inches in diameter so that the stopwatch can be very comfortably held in the operator's hand. A small, conventional lithium battery (represented by circle 26 shown in phantom) may be provided inside the housing 22 to power the electronics within the stopwatch. The stopwatch 20 includes an electronic read-out 30 visible through a transparent face plate 32 having a truncated oval perimeter 34 corresponding in shape to the opening in the front portion 36 of the housing 22. As best shown in FIG. 2, the housing may also include a rear portion 38 sealingly engaged or otherwise tightly connected in conventional fashion to front portion 36 to form the housing 22.

The stopwatch 20 also includes a plurality of conventional operator-actuatable switch means, such as momentary-contact (SPST) pushbuttons 40 and 42, and a semicircular carrying ring 46 pivotally attached at mounting bosses 48 to the housing 20. A thin leather strap or fabric ribbon such as a shoelace may be passed through the ring 46 so that the stopwatch may be carried by the strap or ribbon, if desired. The input switches 40 and 42 are shown protruding through the outer rim 24 of the housing 20, with the first switch or button 40 being disposed at the top of the rim 24 and the second button 42 being spaced apart slightly from the first button, but still above most of the display section 30, for convenient operation by the thumb when held in the right hand. For the left-handed operation, the second input switch 42 may be disposed in location 42', indicated in phantom in FIG. 1.

The read-out 30 of the stopwatch 20 is arranged along a generally planar surface 50 under the transparent protective face plate 32 within a centrally located, broad, vertically arranged region of the front portion 36 of housing 22. The electronic read-out section 30 includes first display means or section 60, which includes four multiple-digit displays 62, 64, 66 and 68, which may be provided with sufficient digits, such as the four shown, to display a measured interval of time in the desired units of time such as in minutes, seconds, and fractions of a second. Display 30 also includes a second display means or section 70 which includes at least one and preferably the three alphabetic displays 72, 74, and 76 (as shown) which may also be alphanumeric displays, if desired. Displays 72 and 74 indicate the mode of operation which the stopwatch 20 is in, either "MILE" or "INT." (for the word "interval"). The display 76, which may read "READY" as shown, indicates the status of the stopwatch, as will be further explained. The read-out 30 includes a third display means or section 80, which preferably is an alphabetic, numeric or alphanumeric display field indicating the specific interval or intervals of time currently being measured or about to be measured by the stopwatch, as will be further explained. As shown in FIG. 1, the display section 80 is preferably comprised of one digit. As those skilled in the art will appreciate, the displays 60 through 80 may be of any conventional or suitable type, such as nematic liquid crystal displays of the type well-known in the wrist-watch and hand-held electronic calculator arts.

The displays 60–80 are conveniently arranged along the broad vertical stripe or central region of the front portion 36 of the housing 22 so that none of the display fields will be obscured by portions of the fingers or hands of the person operating the stopwatch. The display section 60 has its four separate numeric displays 62–68 arranged in individually, vertically adjacent horizontal rows. The second display section 70 has its three alphabetic displays 72–76 similarly arranged in vertically adjacent horizontal rows. The third display section 80 is shown larger than the other display fields 62–68 for ease of viewing, since the number displayed therein relates to more than one of the display fields of display section 70. However, those in the art will appreciate that the specific legends, symbols, sizes and layout of the display sections 60–80 shown in FIG. 1 are merely exemplary, and that any other suitable arrangement, legends, and sizes of display may also be utilized without departing from the broader aspects of the present invention. Display sections 62 through 68 each preferably have digits which are at least one-quarter inch high, for ease of viewing the elapsed times displayed therein.

Figure 3:
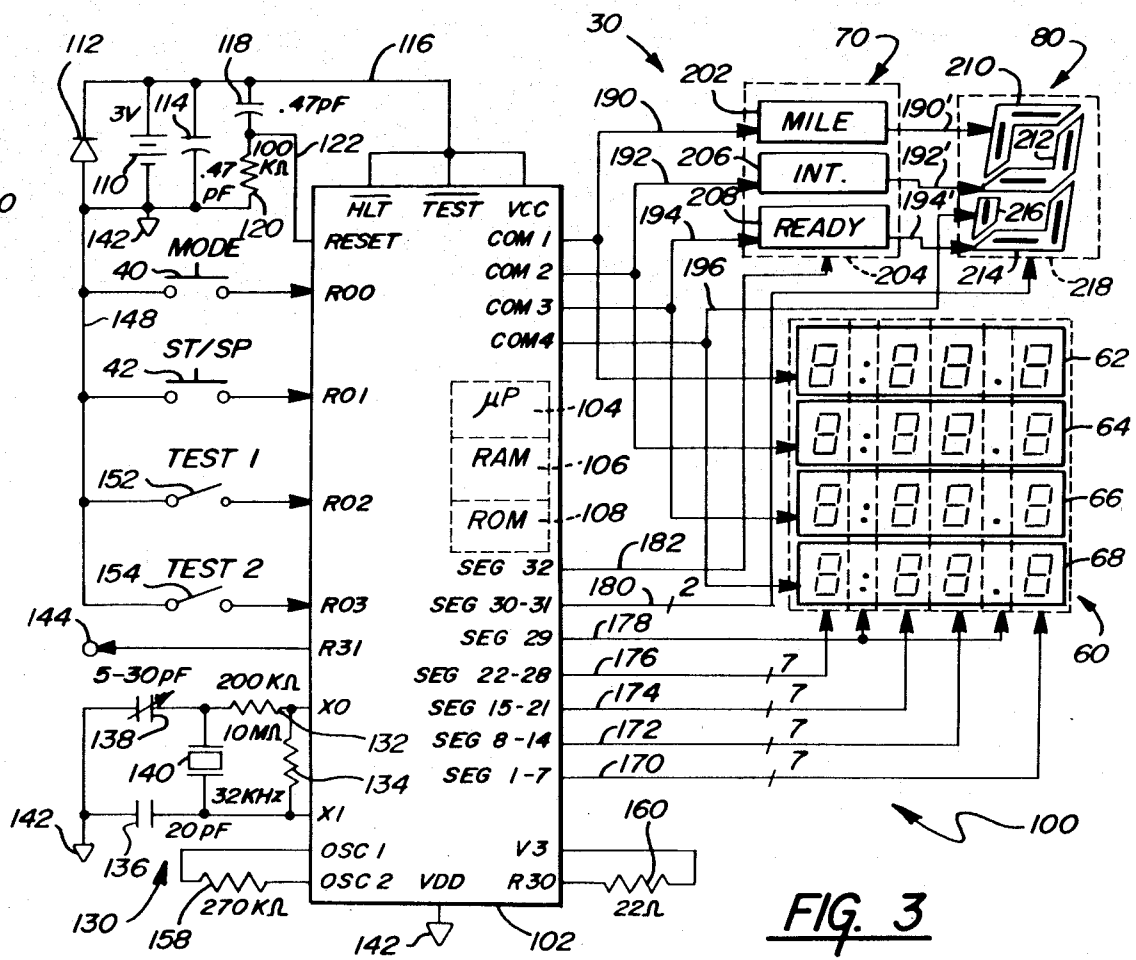
FIG. 3 is a detailed schematic diagram of the presently preferred internal circuitry of the FIG. 1 stopwatch which shows the various interconnections between the microcomputer, discrete components and the several display fields used therein.

FIG. 3 shows a preferred electronic circuit 100 for the electronics used in stopwatch 20. The circuitry 100 has as its principal component a single-chip microcomputer system represented by block 102 which includes a microprocessor 104, main or working memory, such as random access memory (RAM) 106, and a memory for program and other permanent storage such as read-only memory (ROM) 108, which may be of the programmable ROM type. One suitable single-chip microcomputer system is the Hitachi Model HMCS40 Series LCD IV 4-bit single-chip microcomputer system as described in the Hitachi preliminary product bulletin No. U131, dated July, 1984, pp. 1–46, which bulletin is hereby incorporated by reference. Any other conventional or suitable microcomputer system (one or more chips) may be utilized as microcomputer system 102. Since microprocessor-based timekeeping instruments such as wristwatches and stopwatches are well known in the art, a detailed description of the internal operation and construction of microcomputer systems need not be provided here. However, so that the description of the present invention may be more easily understood, it is worth noting that the Hitachi LCD IV chip features 4,096 words of memory for program storage and the like in ROM 108, with each word containing ten bits. Its RAM 106 can store up to 256 digits of data, including display data at four bits per digit. It features internal control circuitry and drive circuitry for operating a liquid crystal display in static, ½ duty factor, ⅓ duty factor and ¼ duty factor modes, using up to four common signal terminals or pins COM1–COM4 and up to 32 segment signal terminals or pins SEG1–SEG32. It also features thirty-two other input/output (I/O) lines, an internal timer/event counter, a built-in oscillator for internal timing functions, and a built-in oscillator for its system clock. It also employs CMOS circuitry within for low-power consumption which facilitates longer-lived operation by battery power. It also features a stand-by or halt mode which uses even less power so that during periods of non-use, power consumption is minimized. In this powersaving mode, the contents of the internal RAM 106, all registers, including the carry and status registers and program counter, are maintained. It operates on a low-voltage (2.5 volts minimum). Thus, all active hardware functions and the flexibility needed for programming the functions provided by the present invention are furnished in the Hitachi LCD IV microcomputer.

The discrete components of circuit 100 shown in FIG. 3 will now be described. Battery 110, which may be a three-volt lithium battery (such as a CR2025 or DL2025 battery) provides power to the microcomputer 102 and the liquid crystal display section 30. A conventional diode 112 of suitable power-handling capability is used to protect the circuit 100 against accidental reverse polarity installation of the battery 110. Capacitor 114 provides power supply decoupling and filtering action so that a more uniform voltage is provided on VCC supply line 116 by battery 110. Capacitor 114 is preferably of the stacked ceramic type with a low inductance value.

Capacitor 118 and resistor 120 form an RC network which provides a power-on reset pulse on line 122 to the input of microcomputer 102, which forces the internal program counter to the reset address. Initially, capacitor 118 is discharged (via the leakage current internal to the capacitor). When the battery 110 is installed, an instantaneous three-volt signal is applied to the input, causing the microcomputer 102 to reset. The voltage on conductor 122 thereafter exponentially decays, which releases the internal reset command and allows the microprocessor 104 to begin program execution.

A conventional oscillator circuit 130, comprised of resistors 132 and 134, fixed capacitor 136, adjustable capacitor 138 and crystal 140 having a natural oscillation frequency of about 32 KHz is connected to timebase or oscillator inputs X0 and X1 of the microcomputer 102. The circuit 130 causes the precise desired crystal oscillation frequency to occur, with resistor 132 providing drive current, resistor 134 providing feedback, and capacitors 136 and 138 providing reference to ground 142. The capacitor 138 is adjusted while monitoring the test point output 144 from I/O pin R31 of microcomputer 102. Output R31 is toggled under program control and is some frequency $F_T$ which is defined by the expression: $F_T = F_O/2^n$, where $F_0$ is the precise frequency of oscillator circuit 130 and n is some number in the range of 5 to 15. If n equals 15, for example, then a two-second period time (or one-second toggle time) square wave would be produced at the test point 144. If the oscillation frequency $F_0$ of the oscillator circuit 130 is 32,768 Hz, and n equals 15, then the state of test point 144 would change from low to high (or vice-versa) once per second. Using this technique to adjust the clock frequency (by adjusting the setting of capacitor 138) is preferable because the test equipment used to monitor the frequency at node 144 does not alter the clock frequency which it is trying to measure. If the probe connected to the counter being used to measure the frequency at test point 144 were instead placed upon the input X1 of microcomputer 102, the loading would in fact change the frequency and cause an inaccurate clock set-up. Thus, use of test point 144 for adjusting the time base of the microcomputer 102 via adjustments to capacitor 138 is preferred for setting the internal time-base means of stopwatch 20, namely oscillator circuit 130, at its desired frequency, which is 32,768 Hz.

The switch 40 is called the Mode switch, and the switch 42 is called the Start/Stop switch, for reasons which will shortly become plain. Switches 40 and 42 are connected on one side by conductor 148 to ground 142 and on the other side to I/O pins R00 and R01, respectively. Both of these inputs pins may be mask-programmed with an internal PMOS pull-up transistor device, and therefore do not require the usual external pull-up resistor. Test switches 152 and 154 may be of any conventional type, and may be optionally be provided to inputs R02 or R03 for testing, debugging and quality control purposes during manufacture, if desired. Specifically, microcomputer 102 may be programmed so that switch 152 turns on all of the LCD segments in order to verify that all segments are indeed working. Microcomputer 102 may be programmed so that when test switch 154 is actuated, the stopwatch 20 will run at an accelerated speed, such as four to sixteen times its normal rate, so that the functional check-out of the stopwatch can be done in a much shorter period of time. Such a visual check-out while the watch is running under accelerated conditions may be performed by a quality control person or by an automatic machine vision system which has been appropriately programmed, and includes mechanical or electronic means which simulate a person operating buttons 40 and 42. Test switches 152 and 154 are normally not accessible once the housing 22 is assembled.

Resistor 158 is used by the internal system clock of microcomputer 102 and forms part of the system's internal clock oscillator. A value of 270 kil-ohms yields a nominal system clock frequency of 200 KHz.

In the power-conserving stand-by mode, the display 30 is shut off. This is accomplished in part by use of a circuit involving the 22 ohm resistor 160. The output R30 is used to provide output pin V3, which is connected internally through microcomputer 102 to the display 30, with a return path to ground 142 through the resistor 160. When pin V3 is high, the display 30 does not draw any current.

The display 30 is preferably comprised of a conventional ¼ duty cycle multiplexed reflective liquid crystal display (LCD), such as a silver foil LCD, which is provided with the various display field 62–68, 72–76 and 80, organized as previously described. The display 30 is driven by multiplexed signals on pins COM-1–COM4 and pins SEG1–SEG32. Computer system 102 allows the segments and common signals to be separately set, and therefore any product of a segment signal and common signal can be addressed separately. Accordingly, 128 display segments ($32\times4=128$) can be addressed. The first display section 60 has four rows of four seven-segment digits ($4\times4\times7=112$ display segments), leaving sixteen available addresses to address the remainder of electronic read-out 30. The sixteen addresses are used to display the legends "MILE," "INT." (interval) and "READY," and the colons and decimal points used in the display fields 62–68 of the first display section 60. The lines 170–176 each represent seven conductors and are used to address the right-most, right-center, left-center and left-most columns of digits in display fields 62 through 68, as shown in FIG. 3. Line 178 is connected to the SEG 29 pin is used to address both the colons and decimal points of display fields 62 through 68. Conductor 180 represents the two segment signals SEG30 and SEG31, which are used to address the seven-segment display 80, in conjunction with the signals COM1-COM4, respectively provided by individual conductors 190–196. As shown in FIG. 3, the legends "MILE," "INT." and "READY" can be implemented as one segment each. In other words, for the display 72 containing the word "MILE," for example, the rectangle 202 represents one electrode, such as the lower electrode, while the dashed rectangle 204 represents the other electrode, such as the upper electrode, which is addressed by signal SEG32 on line 182. Conductors 190', 192', and 194' are extensions of conductors 190, 192 and 194 with the lower electrodes 202, 206 and 208 disposed therebetween. In a similar fashion, the illustration of the display 80 will be understood to consist four lower electrodes 210, 212, 214 and 216 respectively connected to conductors 190', 192', 194' and 196. Two upper electrodes (not shown) located with dashed rectangle 218 and connected via lines 180 to segment signals SEG30 and SEG31 are appropriately positioned above the various lower electrodes 210–216 to permit the seven segments of display 80 to be individually addressed using well-known multiplexing techniques.

In this regard, it should be noted that the Hitachi LCD IV microcomputer automatically executes a conventional one-quarter duty cycle multiplexing scheme when the segment data is written into appropriate address locations reserved for this purpose in RAM 106. An internal LCD driver circuit (not shown) within microcomputer 102 provides the four common signals COM1–COM4. This completes the description of the hardware aspects of circuit 100 of FIG. 3. A detailed functional description of the operation of the stopwatch 20 and microcomputer 102 will now be provided.

The stopwatch 20 has three basic modes of operation: the Off mode, the Mile mode and the Interval mode. The Off mode employs the stand-by mode provided by microcomputer system 102 for ultra-low power consumption. During the Off mode, the display 30 is off and appears blank, and the contents of RAM 106 are maintained (i.e. not lost). In the Mile mode, measured elapsed times for four successive time intervals having a common starting time (which may be called the start point) and different stopping times (which may be called the stop points) can be simultaneously displayed. The utility of the simultaneous display of four measured, elapsed times may be easily understood by using a one-mile thoroughbred horse race as an example. Before the race begins, the stopwatch 20 is reset using the first pushbutton 40, in a manner that will be further explained. Then, at the beginning of the race, the timing function of the watch 20 is activated by pushing start/-stop button 42, which starts the stopwatch accumulating a time value, by incrementing an internal counter using clock or timing signals from internal time-base circuit 130. The instantaneous elapsed time value being accumulated is converted (as may be necessary) from an internal binary notation to the desired minutes, seconds and fraction of a second decimal digit notation, which is displayed in the first display field 62 of the first display section 60. At the ¼ mile mark, the user pushes button 42, which freezes the display of time in display field 62. Immediately thereafter, the elapsed time, which is still accumulating, is displayed in the second display field 64. When the horse of interest passes the one-half mile mark, the user presses the button 42 again, which freezes the elapsed time shown in display 64. The accumulating elapsed time is then showed in the third display field 66 and continues to increment until the operator pushes the button 42 again as the horse crosses the three-quarter mile mark. The accumulating elapsed time is immediately thereafter displayed in the fourth display field 68, which is frozen by the operator pressing button 42 for a fifth time. At this point, the display section 60 is simultaneously displaying the four elapsed times corresponding to the measured one-quarter mile, one-half mile, three-quarter mile and the one-mile elapsed times of the particular horse of interest.

In the preferred embodiment of stopwatch 20, the Mile mode just described is provided four times, which are all identical to the foregoing description, and are designated by the use of display field 72 and display field 80 as the Mile 1, Mile 2, Mile 3 and Mile 4 modes. Specifically, the display field 80 is used to indicate the numbers 1 through 4, while the display field 72 displays the word "MILE." Each of the four Mile modes can record and store for future reference the split times (i.e. the one-quarter mile time, the one-half mile time, and the three-quarter mile time) as well as the mile time frozen or held in display fields 62–68. Thus, four complete mile races with one-quarter mile splits can be recorded and stored in the stopwatch 20.

The Interval mode is used to measure, display, record and store up to nine separate interval times and is of great use whenever interval training is employed, as is often done in training short-distance racing horses and short and moderate distance runners, for example. In horse racing, the typical interval training using stopwatch 20 includes running the horse hard for one-quarter mile and measuring and displaying this one-quarter mile time in first display field 62. This one-quarter mile time is also recorded in the memory 106 of the microcomputer 102. Next, a recovery time is provided where the horse is jogged or briskly walked, and this recovery time is normally not measured or recorded. Then, the horse is run hard for another one-quarter mile interval, which is recorded as the second interval time in memory 106 and is displayed in the second display field 64. This process may be continued all the way up through the ninth timed interval. When this training sequence is done, the trainer may recall from memory 106 all of the recorded interval times, in a manner which will be further explained below. In the Interval mode, the display field 72 is blank, and the display 74 shows the "INT." legend. The display field 80 indicates the number of the interval which the stopwatch 20 is ready to measure or which is being measured. When the stopwatch 20 is not measuring an interval but is prepared to measure an interval, the display field 76, which normally is blank, displays the legend "READY."

A more detailed description of the operation of the Mile and Interval modes will now be given. Assuming that the stopwatch 20 is in the Off mode, pressing the mode button 40 once and releasing it causes the watch to switch into the Mile 1 mode and "MILE 1" will be displayed by display fields 72 and 80. The rest of the display may contain the split times or display the word "READY" in display field 76, depending on whether or not previously recorded times have been erased. The currently displayed times are erased whenever the operator holds down the mode button 40 for more than a predetermined length of time, such as three seconds. Because only the data which is being displayed is erased, the Mile 1 data can be erased, while leaving Mile 2, Mile 3, Mile 4 and the Interval mode data unchanged.

If the word "READY" is displayed in the Mile Mode, then the stopwatch 20 is ready for the measuring (i.e. timing) and recording of the first through fourth time intervals to be displayed in the first through fourth fields 62–68. As previously explained, Start/Stop button 42 is pressed once at the start of the race to initiate the timing function and is pressed once at the end of the first, second, third, and fourth distance intervals, such as the onequarter, one-half, three-quarters and one-mile mark. Once this has been done, the display 30 will contain the word "MILE 1" and have the first through fourth measured elapsed times from top to bottom in display section 60. In the preferred embodiment of stopwatch 20 used for timing horse races, the fractions of a second indicated by the right-most digits of display fields 62-68 are provided in one-fifth second divisions, and valid numbers for these rightmost digits are "-, 1, 2, 3, 4," which represent 0/5, 1/5, 2/5, 3/5 and 4/5 seconds. (This particular notation for fifths of a second is widely used in the U.S. horse racing industry.) Thus, when this embodiment of stopwatch 20 is used to time a horse race, typical times displayed might be "0:30.1" in display field 62, "1:00.1" in the second display field 64, "1:31.4" in the third display field 66, and "2:02:-" in the fourth display field 68. The time in the display field 68 may be read as "two zero two flat" with the hyphen or dash equaling the number zero.

Once the four display fields 62–68 are frozen in any of the Mile modes 1–4, further pressing of the start/stop button 42 has no effect. However, pressing the mode button 40 once, and releasing it within three seconds, will place the watch into the Mile 2 mode, which operates exactly like the Mile 1 mode just described. In the preferred embodiment of the present invention, it is the release of the mode button that causes the change of modes, except that if the button 40 is held for greater than three seconds, the data shown in the display field 62–68 will be erased from memory 106, and the fields 62–68 will be blank, while the stopwatch 20 remains in the same mode (such as Mile 2 mode if it were in Mile 2 mode), and the legend "READY" will be displayed in display field 76. If the stopwatch 20 is in the Mile 2 mode, and the mode button 40 is pressed again and promptly released, it will cause the stopwatch to go into the Mile 3 mode. Similarly, pressing button 40 again and promptly releasing it will cause the stopwatch to go into the Mile 4 mode.

If the mode button 40 is pressed and promptly released when the stopwatch 20 is in the Mile 4 mode, the stopwatch will go into its Interval mode, with "INT. 1" being displayed in display fields 74 and 80, and display field 72 will be blank. Either the word "READY" will be displayed in field 76, or the measured times recorded when the Interval mode was last used will be displayed. In order to erase previously recorded times now being displayed, the mode button 40 must be pressed and continuously held for more than a predetermined period of time, such as three seconds, as previously explained. When this is done, the word "READY" will appear in field 76, and the stopwatch will be ready to measure, display and record the interval data. In the "INT. 1" mode, the first display field 62 will begin displaying the incrementing or accumulating time, once the button 42 is pressed. At the end of the interval, button 42 is pressed again, and the elapsed time then showing in field 62 will be frozen and an equivalent value stored in the memory 106 of microcomputer 102. In a similar fashion, the second interval of time will be measured, displayed in field 64, and recorded by pressing the button 42 once at the beginning and once at the end of the second interval to be measured. This process is repeated again for the third and fourth intervals which are displayed in display fields 66 and 68 respectively.

At the start of the fifth interval, "INT. 2" will be displayed in fields 74 and 80. In order to have a display field in which to display the incrementing time for the fifth interval, the elapsed times for the first through fourth intervals will be scrolled upward, so that the first interval of time is scrolled off of the top of first display section 60, and the second, third, and fourth intervals of time are respectively shown in display fields 62, 64, and 66. Accordingly, display field 68 will now be blank and may be used to display the incrementing fifth interval of time. When the button 42 is pushed again, the incrementing time in display field 68 is frozen and represents the elapsed time for the fifth interval.

At the start of the sixth interval, "INT. 3" is displayed in fields 74 and 80. The display fields of section 60 are scrolled once again so that the third, fourth and fifth intervals of time are respectively displayed in field 62, 64 and 66. This leaves display field 68 blank, so that it can display the accumulating time of the sixth interval, which is frozen when the button 42 is pushed once again.

The seventh, eighth and ninth intervals are handled in a similar manner. Thus, during the measurement of the ninth interval, "INT. 6" will be displayed in fields 74 and 80, with the sixth, seventh and eighth measured intervals of time being displayed in fields 62, 64, and 66, while the ninth interval is displayed in field 68. The timing of the ninth interval is stopped, as before, by pressing Start/Stop button 42 again. At this point, pressing button 42 once more will cause the previously recorded first through fourth intervals to be displayed in fields 62–68, respectively.

Pressing button 42 once again will cause the legend "INT. 5" to be displayed in display field 74 and 80 and the previously measured fifth through eighth intervals to be displayed from top to bottom in fields 62–68. Pressing button 42 once again will cause the legend "INT. 9" to appear in fields 74 and 80 and the ninth interval only will be displayed in field 62. Fields 64–68 will be blank. Pressing the start/stop button 42 again will cause the legend "INT. 1" to be displayed in fields 74 and 80 and the recorded elapsed times in memory 106 for the first through fourth intervals to be displayed from the top to the bottom of display section 60. This sequence of redisplaying previously measured and recorded times will repeat indefinitely, with the pressing of the button 42, until the mode button 40 is pressed and promptly released to change the mode of operation, or is pressed and held for more than the predetermined amount of time (e.g. three seconds) to erase the previously recorded time intervals.

When the stopwatch 20 is in any Interval mode and the mode button 40 is pressed and promptly released, the Off mode is entered, the display goes blank, and the microcomputer 102 enters its Stand-By mode. In this mode, microcomputer 102 "wakes up" every 16 milliseconds, at which time it polls the input R00 to determine whether the contact of mode switch 40 is closed, indicating the mode switch is then actuated. If actuation of mode switch 40 is detected, the stopwatch 20 enters the "MILE 1" mode, and the whole sequence of events starts over again.

It will be readily appreciated that the preferred embodiment of the stopwatch 20 described in FIGS. 1 through 3 has a maximum displayed time of nine minutes, fifty-nine and 4/5 seconds in any one display field 62–68. If desired, the microcomputer system 102 can be readily programmed to permit the display fields 62–68 to measure, display and record intervals of time to within 0.1 seconds accuracy. Moreover, as those skilled in the art will readily appreciate, the size of the display fields can be decreased, so as to have fewer digits, or increased, so that accuracies greater than one-tenth of a second can be displayed, if desired, and/or times greater than nine minutes, fifty-nine seconds can be measured, displayed and recorded.

While the foregoing description of the present invention has been described primarily with reference to horse racing and distance intervals of a quarter of a mile each, it should be readily appreciated that the electronic stopwatch of the present invention can readily be used for numerous sporting and other timing events where the successive measurements and simultaneous display of a plurality of elapsed times would be beneficial or desirable. Such sporting events may include bicycle and auto racing, for example, as well as many timed track and swimming events. The electronic stopwatch of the present invention may be profitably utilized in many types of athletic training, such as exercise regimes where effort is exerted over successive intervals of time which are measured.

Those in the art should appreciate that the above-described sequence of operating the electronic stopwatch of the present invention with only two buttons helps minimize its cost by reducing number of sturdy input switches or buttons which are required. The use of additional display fields, such as fields 72–76 and 80, makes it easy for the operator or user to determine the precise mode that the stopwatch is in, as well as which "Mile" mode or interval of time is being measured at any given moment. Clearly, the painted legends alongside of indicator lights (such as LEDs or the like), could be used in place of the display fields 72–76. However, since the LCD-type display consumes a minimum of energy, it is preferred over LEDs or other indicator lights in applications where battery life and minimal power consumption are important. Also, the legends of the display fields 72, 74 and 76 may be changed to whatever other convenient abbreviations on mneumonics may be appropriate for the particular sporting event the stopwatch 20 will be used with.

Those skilled in the electronic watch arts are well-acquainted with the details of programming a conventional microcomputer system or microprocessor. One of ordinary programming skill could readily write a suitable program to carry out all of the above-described functions associated with stopwatch 20. Accordingly, such programming details need not be set forth here.

It is recognized that those skilled in the art may make various modifications or additions or additions to the preferred embodiments chosen to illustrate our invention without departing from the spirit and the scope of the present contribution to the art. For example, electronic displays having as few as two or more than four multi-digit numeric displays may be provided. Similarly, the time periods used in stopwatch 20, namely minutes, seconds, and fractions of a second, may easily be changed to different periods such as hours and minutes or other intervals of time, should it be required for other applications. Accordingly, it is to be understood that the protection sought and to be afforded hereby should be deemed to extend to the subject matter claimed and all equivalents thereof fairly within the scope of the invention.

We claim:

1. A hand-holdable, self-contained, portable stopwatch having a plurality of different modes of operation for measuring and displaying a plurality of intervals of time representing the elapsed times a racer has taken to cover successive predetermined distances, comprising:

time-base means for providing an internal source of timing signals for the stopwatch;

first operator-actuatable input switch means for generating first input commands designating start and stop points of the plurality of intervals of time to be measured;

second operator-actuatable input switch means for generating second input commands for switching the stopwatch between at least first and second distinct timing modes of operation;

timing means connected to the time-base means for successively measuring the duration of each of the plurality of intervals of time designated by the input commands received from the first input means;

first display means for simultaneously displaying at least a plurality of multiple-digit values respectively representing the measured duration of at least two of the plurality of intervals of time;

second display means distinct from the first display means for indicating when the stopwatch is in its first timing mode when the stopwatch is in its second timing mode;

third display means distinct from the first display means for displaying at least one alphanumeric symbol indicating which of the plurality of intervals of time the stopwatch is currently set up to time, and wherein said timing means including microprocessor means for controlling the sequence of automatic operations of the stopwatch in response to input commands received from the first and second input means, including automatically operating the display means and providing the first and second timing modes, with the operation of the first timing mode including measuring at least a plurality of overlapping intervals of time having a common start point and different stop points, and with the operation of the second timing mode including measuring at least a plurality of successive non-contiguous intervals of time such that the stop point of any one such interval is separated by an operator-determined length of time from the start point of the next interval of time if any to be measured.

2. A stopwatch as in claim 1, wherein:

the first and second input switch means each include momentary-contact pushbuttons, the first display means includes four separate numeric displays each having at least four digits for displaying a measured interval of elapsed time in minutes, seconds and fractions of a second, and the second display means includes at least a first multiple character display which spells out at least a first legend to indicate at least the timing mode the stopwatch is in.

3. A stopwatch as in claim 2, wherein:

the first, second and third display means are arranged along a generally planar surface, with the four displays of the first display means being arranged in individual vertically adjacent horizontal rows, and the second and third display means being located generally above the four displays of the first display means, and the second display means includes a second multiple character display for spelling out a second legend to indicate a mode of operation the stopwatch which is distinct from that indicated by the first multiple character display of the second display means.

4. A stopwatch as in claim 3, further comprising:

a housing having a generally circular outer rim less than three inches in diameter and a front portion near which the generally planar surface is disposed, and wherein the first, second and third display means are located within a centrally located broad vertically arranged region adjacent to the front portion, the first and second input switch means each include as its only operator-actuatable input device its one momentary contact pushbutton, and the two momentary contact pushbuttons of the first and second input means are located generally above the four displays of the first display means and protrude from the outer rim of the housing.

5. A stopwatch as in claim 2, further comprising:

internal battery means for providing power to operate the stopwatch, and wherein the timing means includes stand-by mode means for conserving battery power by keeping the display means off until such time that an input command is received, said means including monitoring means for periodically checking the state of the input means to determine if one of the input means is actuated.

6. A stopwatch as in claim 1, wherein:

the timing means includes memory means for storing digital values corresponding to the measured durations of the plurality of intervals of time displayed as multiple-digit values during the first timing mode and the second timing mode, and means responsive to the duration that at least one of the pushbuttons of the input switch means is held in an actuated state for clearing out the stored digital values, and means for redisplaying previously displayed multiple digit values not currently displayed by accessing stored digital values in the memory means.

7. A hand-holdable, self-contained, portable timekeeping apparatus for measuring and displaying at least a first plurality of intervals of elapsed time, comprising:

time-base means for providing an internal source of timing signals for the apparatus;

operator-actuatable input means for generating input commands designating start and stop points of the plurality of intervals of elapsed time to be measured and displayed during a first mode of operation of the apparatus and for switching into and out of the first mode of operation;

timing means connected to the time-base means for successively measuring the duration of each of the intervals of elapsed time designated by the input commands received from the input means; and display means for simultaneously displaying a plurality of multiple-digit values representing at least two of the plurality of intervals of elapsed time measured by the timing means, the display means including at least a plurality of separate numeric display fields each for displaying the plurality of multiple-digit values in terms of minutes, seconds and fractions of a second, and wherein the timing means includes microprocessor means for controlling the automatic operation of the apparatus in response to input commands received from the input means, the microprocessor means being programmed to provide the first mode of operation wherein the timing means measures at least a plurality of overlapping intervals of time having a common start point and different successive stop points, to pass to the display means an accumulating value which represents the substantially instantaneous value of each interval of elapsed time for which a stop point has not yet been identified, and to cause the display means to display the accumulating value in each one of the respective numeric display fields, such that the accumulating value is displayed in a first one of the display fields until such time as the stop point for the interval of elapsed time associated with the first one of the display fields is received, at which time the accumulating value is displayed in a second one of the display fields until such time as the stop point for the interval of the elapsed time associated with the second one of the display fields is received.

8. A timekeeping apparatus as in claim 7, wherein:

the display means has four numeric display fields, and the microprocessor means is further programmed to cause the accumulating value to be displayed in a third one of the display fields after the stop point for the interval of elapsed time associated the second one of the display fields is received, until such time as the stop point for the interval of elapsed time associated with the third one of the display fields is received, at which time the accumulating value is displayed in a fourth one of the display fields until such time as the stop point for the interval of elapsed time associated with the fourth one of the display fields is received.

9. A timekeeping apparatus as in claim 7, wherein, during the first mode of operation, the timing means, in response to a predetermined input command sequence from the input means, measures at least a second plurality of overlapping intervals of time having a common second start point and different successive stop points, and the display means includes an alphanumeric display field for indicating the mode of operation of the apparatus and when the display means is displaying the first plurality of overlapping intervals of time and when it is displaying the second plurality of overlapping intervals of time.

10. A timekeeping apparatus as in claim 9, wherein:

the timing means includes memory means for storing digital values corresponding to the measured durations of the first plurality of intervals of overlapping time and to be measured durations of the second plurality of intervals of overlapping time, and means for redisplaying previously displayed multiple digit values corresponding to the stored values not currently displayed by accessing stored digital values in the memory means.

11. A timekeeping apparatus as in claim 7, wherein:

the microprocessor means is further programmed to provide a second mode of operation wherein the timing means measures at least a plurality of successive non-contiguous intervals of elapsed time such that the stop point of any one such interval is separated by an operator-determined length of time from the start point of the next such interval of time if any to be measured, and to cause the display means to display at least a plurality of multiple-digit values representing at least two of a plurality of successive non-contiguous intervals of elapsed time in terms of minutes, seconds and fractions of a second.

12. A timekeeping apparatus as in claim 11, wherein:

the microprocessor means is further programmed to pass to the display means in the second mode of operation a current accumulating value which represents the substantially instantaneous value of the interval of elapsed time which is then being measured if any and for which a stop point has not yet been identified, and to cause the display means to display in the second mode of operation the current accumulating value in a corresponding one of the respective numeric display fields, with the current accumulating value being displayed in each respective one of the display fields after the start point for the associated interval of elapsed time has been identified and until such time as the stop point for the interval of elapsed time is received.

13. A timekeeping apparatus as in claim 11, wherein, during the second mode of operation, the timing control means, in response to a predetermined input command sequence from the input means, measures at least a second plurality of successive, non-contiguous intervals of time having a distinct start point organized such that the stop point of any such interval is separated by an operator-determined length of time from the start point of the next such interval of time if any to be measured, and the display means includes an alphanumeric display field for indicating the mode of operation of the apparatus and when the display means is displaying the first plurality of intervals of time and when it is displaying the second plurality of intervals of time.

14. A method of operating a hand-holdable, self-contained, portable timekeeping apparatus for measuring and simultaneously displaying a plurality of intervals of time, comprising the steps of:

(a) providing an internal source of timing signals for the apparatus;

(b) generating input commands in response to operator actuations of input switch means, which commands designate start and stop points of intervals of time to be measured and operator selection of mode of operation the apparatus is to be in;

(c) measuring in a first mode of operation a first plurality of intervals of elapsed time designated by input commands received from the input switch means which intervals have a common start point and different stop points; and (d) simultaneously displaying a plurality of values representing at least two of the intervals of elapsed time measured during step (c).

(e) measuring in a second mode of operation a second plurality of intervals of elapsed time designated by input commands received from the input switch means which intervals of time are successive and non-contiguous; and (f) simultaneously displaying a plurality of values representing at least two of the intervals of elapsed time measured during step (e).

15. A method as in claim 14, wherein the timekeeping apparatus is a stopwatch for timing a racing event, and the apparatus includes a microprocessor means for controlling the automatic operation of the apparatus with memory means for storing elapsed time values, and the method further comprises:

(g) storing a digital value in the memory means corresponding to the measured duration of each of the plurality of intervals of time displayed in step (d), and (h) redisplaying, in response to a predetermined operator-actuated input command sequence, at least a plurality of previously-displayed values of intervals of elapsed time not currently being displayed by accessing stored values in the memory means.

16. A method as in claim 14, wherein the internal source of timing signals includes an oscillator circuit provided with a crystal and having an adjustable oscillation frequency, further comprising the steps of:

(e) providing an electronic read-out with plural display fields for carrying out step (d), and a microcomputer electrically connected to the internal source of timing signals, the input switch means and the electronic read-out, and (f) within the microcomputer, dividing the oscillation frequency of the oscillator circuit by $2^n$, where n is a positive integer having a value of at least 5, to produce a subfrequency signal;

(g) outputting the subfrequency signal through an output port of the microcomputer, thereby allowing measurement of the adjustable oscillation frequency by one or more external probes without loading of the oscillator circuit by the one or more external probes.

17. A method as in claim 14, further comprising the step of:

(h) speeding up the operation of the apparatus during functional check-out so that the apparatus runs at at least twice its normal speed, whereby the operation of the apparatus can be visually checked out at accelerated speed.

* * * * *